United States Patent [19]

Sjöstrand

[11] 3,967,521

[45] July 6, 1976

[54] HAMMER FOR PIANOS AND SIMILAR INSTRUMENTS

[75] Inventor: Gunnar Sjöstrand, Atvidaberg, Sweden

[73] Assignee: Incentive AB, Stockholm, Sweden

[22] Filed: Apr. 30, 1975

[21] Appl. No.: 573,133

[30] Foreign Application Priority Data

May 15, 1974 Sweden ..... 7406462

[52] U.S. Cl. ..... 84/254

[51] Int. Cl.[2] ..... G10C 3/18

[58] Field of Search ..... 84/254, 422 S, 404

[56] References Cited

UNITED STATES PATENTS

| | | | |
|---|---|---|---|
| 912,860 | 2/1909 | Laker | 84/254 |
| 959,190 | 5/1910 | Young | 84/254 |
| 2,932,231 | 4/1960 | Miessner | 84/254 |

*Primary Examiner*—Stephen J. Tomsky

*Attorney, Agent, or Firm*—Fisher, Christen & Sabol

[57] ABSTRACT

A system for adjusting the tonal quality of piano hammers or similar objects consists of incorporating a tensioning device into the device for attaching the string-engaging cover to the hammer so that the stiffness of the cover may be varied. The cover itself may consist of an elastic rubber-like material.

7 Claims, 3 Drawing Figures

HAMMER FOR PIANOS AND SIMILAR INSTRUMENTS

The present invention refers to a hammer for pianos and similar instruments which hammer is made to strike a string or tuned plate for generating a tone, the part of the hammer which strikes the string or tune plate being provided with a cover.

Hammers for pianos or similar instruments usually have a core made of wood or some other hard material. A direct stroke by a hammer made of wood against a string would, however, give a much too special tone wherefore hammers in pianos ever since the first piano mechanics was made by Bartolomeo Christofori in the beginning of the 18th century have been provided with a cover. Different materials have thereby been used, nowadays the cover is usually made of felt. However, the use of felt as a cover involves several disadvantages.

A new piano must when manufactured be intoned, i.e. the stiffness of the striking material for each hammer must be adjusted for obtaining a uniform clang across the complete range of tones. This intonation includes a softening of the felt material for each hammer individually and requires a long technical experience and is very time-consuming. Furthermore, even a short time use of the instrument gives rise to grooves in the hammer felt whereby the material gradually becomes stiffer and the striking surface broader which in turn changes the tone quality. Different hammers of the key-board are used to a different extent which makes the tone quality uneven over the range of tones. Especially in the middle of the key-board the lower keys which are used most frequently obtain a sharper tone quality than the upper keys.

It is therefore an object of the present invention to provide a hammer which can be rapidly intoned and which gives a very stable tone quality.

The characteristics of the invention will appear from the claims attached to the specification.

Figure 1:
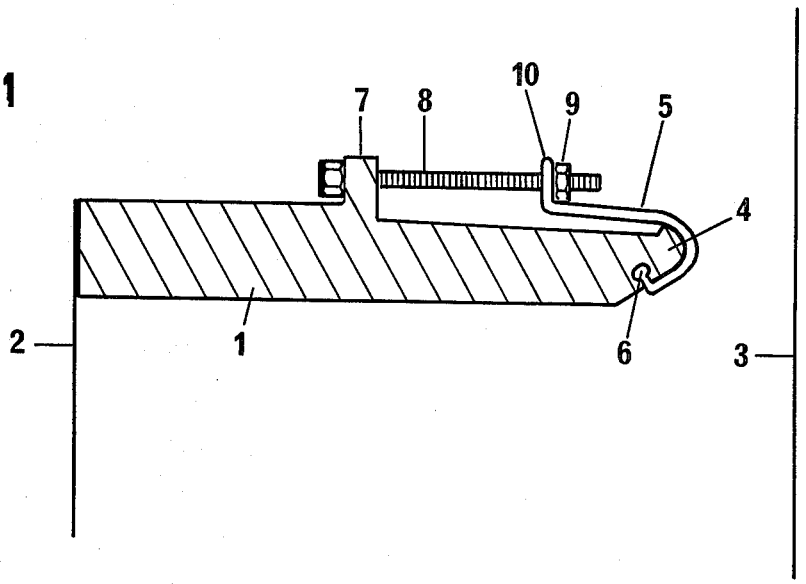
Figure 2:
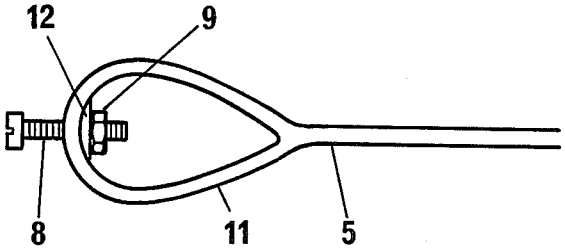
Figure 3:
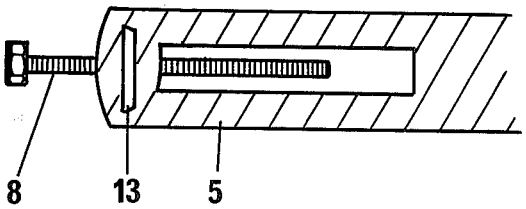

The invention will now be described in detail, reference being made to the attached drawing in which:

FIG. 1 shows a preferred embodiment of the hammer according to the invention, FIGS. 2 and 3 show alternative embodiments of an attachment device included in the hammer according to the invention.

In FIG. 1, reference 1 denotes the core of a hammer consisting of wood or some other hard material. The hammer is connected to a key via a piano mechanism known per se and indicated by reference 2. Reference 3 denotes a string which is struck by the hammer when a tone is to be generated. Across the part 4 of the core which is opposite to the string a cover 5 is arranged which consists of an elastic band. At the reference 6 a first attachment device is arranged for attaching the band to the core. The device 6 consists of a thickened end of the band 5 which is introduced into a groove in the core. A second attachment device consists of a protruding part 7 of the core which is provided with a screw 8. The screw is provided with a nut 9 which engages a part 10 of the band. The band is thereby fixed to the core. By turning the screw the tension of the band 5 between the attachment point 6 and the nut 9 can be varied.

FIG. 2 shows an alternative variable attachment device for the band 5. The band 5 is provided with a loop 11 through which the screw 8 has been introduced. The nut 9 suitably engages the loop 11 by means of a screw washer 12. The detail 7 is not shown in FIG. 2.

In FIG. 3 there is shown a further embodiment of the variable attachment device. A threaded bar 13 has been embedded into the band 5, the screw 8 running in the thread. The detail 7 is not shown in FIG. 3.

The band 5 which constitutes the cover of the hammer can thus be given different tensions and thus different degrees of stiffness. The intonation of a hammer can thereby be performed very fast by means of turning the screw 8. The hammer according to the invention has furthermore the advantage that an intonation that has been made too soft could be made harder when needed or vice versa. In the covers known hitherto, the material can usually only be softened whereby the intonation must be performed very carefully and becomes very time-consuming. By using the hammer according to the invention a new intonation can be performed simply and rapidly after some use of the instrument if desired. Furthermore, the elastic material to be used, for instance rubber, is practically undestructable and no grooves appear in the material after use. Therefore, the tone quality is very stable. Furthermore, the use of an elastic rubber material or similar materials gives a more pleasant tone spectrum in certain instruments. Sometimes, especially in the treble part of the instrument which is not subject to the same wear as the other tone range, it could be advantageous in order to obtain lighter tone effects to embed stiff tissue on the part of the hammer cover which strikes the string.

The friction surface between the band and the part 4 of the core which is close to the string at the striking should be as small as possible in order to facilitate the movement of the band when changing the tension. The band should then either engage the core or be completely free running in order not to generate disturbing noise from strokes by the band on the core.

The attachment devices shown in the embodiments all comprise a screw attached to the core of the hammer and a nut which engages the band. It is of course possible that the attachment device could consist of a screw which engages the band and which is provided with a nut which engages the core. Furthermore, the band could of course be provided with variable attachment devices in both ends.

Finally, it is of course obvious that the string or tune plate can be replaced by any tone generating body, which is struck by a hammer.

I claim:

1. Hammer for pianos or similar instruments having a stringed or tuned plate to be struck by the hammer, comprising a core having a surface facing said string or plate, and a cover disposed on said surface consisting of a band made of elastic material, one end of said band being fixedly attached to said core, the other end of the band being attached to the core by an adjustable tensioning device for varying the tone by adjusting the tension of the band.

2. Hammer according to claim 1, wherein said band is made of rubber.

3. Hammer according to claim 1, wherein said tensioning device includes two elements comprising an elongated threaded screw and a threaded nut on said screw, one of said two elements being in engagement with the core and the other of said two elements being in engagement with said other end of the band.

4. Hammer according to claim 3, wherein said band is made of rubber.

5. Hammer according to claim 3, wherein said screw is secured to said core.

6. Hammer according to claim 5, wherein said threaded nut comprises a bar embedded in said band.

7. Hammer according to claim 6, wherein said band is made of rubber.

* * * * *